US012716607B2

(12) United States Patent
Mou et al.

(10) Patent No.: US 12,716,607 B2
(45) Date of Patent: Aug. 25, 2026

(54) INDOOR AIR POLLUTION DETECTING AND PURIFYING PREVENTION METHOD

(71) Applicant: Microjet Technology Co., Ltd., Hsinchu (TW)

(72) Inventors: Hao-Jan Mou, Hsinchu (TW); Chin-Chuan Wu, Hsinchu (TW); Yung-Lung Han, Hsinchu (TW); Chi-Feng Huang, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 517 days.

(21) Appl. No.: 18/134,332

(22) Filed: Apr. 13, 2023

(65) Prior Publication Data

US 2023/0400209 A1 Dec. 14, 2023

(30) Foreign Application Priority Data

Jun. 14, 2022 (TW) ..... 111122029

(51) Int. Cl.

| | |
|---|---|
| ***F24F 11/63*** | (2018.01) |
| ***F24F 8/10*** | (2021.01) |
| *F24F 110/64* | (2018.01) |
| *F24F 110/66* | (2018.01) |
| *F24F 110/70* | (2018.01) |
| *F24F 110/72* | (2018.01) |

(52) U.S. Cl.

CPC ..... *F24F 11/63* (2018.01); *F24F 8/10* (2021.01); *F24F 2110/64* (2018.01); *F24F 2110/66* (2018.01); *F24F 2110/70* (2018.01); *F24F 2110/72* (2018.01)

(58) Field of Classification Search

None

See application file for complete search history.

(56) References Cited

U.S. PATENT DOCUMENTS

| | | | | |
|---|---|---|---|---|
| 9,618,222 | B1 * | 4/2017 | Hussain | G05B 19/048 |
| 11,268,724 | B2 * | 3/2022 | Liu | F24F 11/65 |
| 2016/0334378 | A1 * | 11/2016 | Maddila | G01N 33/0063 |
| 2017/0261979 | A1 * | 9/2017 | Km | B25J 9/1664 |

(Continued)

FOREIGN PATENT DOCUMENTS

| | | |
|---|---|---|
| TW | 201903336 A | 1/2019 |
| TW | 202217207 A | 5/2022 |

*Primary Examiner* — Nathan L Laughlin

(74) *Attorney, Agent, or Firm* — Birch, Stewart, Kolasch & Birch, LLP

(57) ABSTRACT

An indoor air pollution detection and purifying prevention method is disclosed and includes: providing a plurality of gas detection devices disposed in an indoor space for detecting air pollution and outputting air pollution data; and providing a plurality of filtration devices disposed in the indoor space. Each filtration device includes a driver for receiving the air pollution data. When the driver determines that air pollution data exceeding a safety detection value, the driver controls the corresponding filtration device to be enabled. The indoor space has a cardinal number of ten-pings area, the cardinal number is multiplied by 13 to obtain a maximum number, and the plurality of gas detection devices are disposed in the indoor space based on the maximum number for enabling the plurality of filtration devices, thereby filtering and purifying the air pollution in the indoor space to generate a clean and safely breathable air state.

15 Claims, 21 Drawing Sheets

(56) References Cited

U.S. PATENT DOCUMENTS

| | | | | |
|---|---|---|---|---|
| 2020/0224915 | A1* | 7/2020 | Nourbakhsh | F24F 11/54 |
| 2021/0223220 | A1* | 7/2021 | Fan | G01N 33/0036 |
| 2022/0235955 | A1* | 7/2022 | Park | F24F 11/63 |
| 2023/0014295 | A1* | 1/2023 | Davis | F24F 3/16 |
| 2025/0012466 | A1* | 1/2025 | Sabu | F24F 11/46 |

* cited by examiner

INDOOR AIR POLLUTION DETECTING AND PURIFYING PREVENTION METHOD

CROSS-REFERENCE TO RELATED APPLICATION

This application claims priority to Taiwan Patent Application No. 111122029, filed on Jun. 14, 2022. The entire contents of the above-mentioned patent application are incorporated herein by reference for all purposes.

FIELD OF THE INVENTION

The present disclosure relates to a method for implementing an air-pollution exchange in an indoor space, and more particularly to a method for locating air pollution in an indoor space in order to implement the detection, filtration and purification.

BACKGROUND OF THE INVENTION

In recent years, people pay more and more attention to the air quality around their living environment. Particulate matter (PM), such as $PM_1$, $PM_{2.5}$ and $PM_{10}$, carbon monoxide, carbon dioxide, total volatile organic compounds (TVOC), formaldehyde and even suspended particles, aerosols, bacteria and viruses contained in the air and exposed in the environment might affect human health, and even endanger people's life.

However, it is not easy to control the indoor air quality. In addition to the air quality of the outdoor space, the air environmental conditions and pollution sources, especially the microorganism including one of bacteria, fungi and virus originated from poor air circulation in the indoor space, are the major factors that affect indoor air quality. In order to rapidly improve the indoor air quality, several devices, such as air conditioners or air purifiers are utilized to achieve the purpose of improving the indoor air quality. However, the air conditioners and the air filters are for indoor air circulation, and cannot remove most harmful gases, especially harmful gases such as carbon monoxide or carbon dioxide.

Therefore, in order to immediately purify the air quality, reduce breathing of harmful gases in the indoor space, instantly monitor the indoor air quality, and rapidly purify the indoor air when the indoor air quality is poor, it becomes the major issue of the present disclosure to find a solution to dispose an effective number of gas detection devices at the lowest cost in the indoor space, rapidly detect and locate the air pollution, and effectively control a plurality of filtration devices to generate an intelligent airflow convection and accelerate the airflow in a desired direction(s), so that the air pollution is filtered and cleaned to a safety detection value and a clean and safely breathable air state is obtained.

SUMMARY OF THE INVENTION

One object of the present disclosure is to provide an indoor air pollution detecting and purifying prevention method. By disposing an effective number of gas detection devices at the lowest cost in the indoor space, it allows to rapidly detect and locate the air pollution, as well as effectively control a plurality of filtration devices to generate an intelligent airflow convection and accelerate the airflow in a desired direction(s), therefore the air pollution is filtered and cleaned to reach a safety detection value and a clean and safely breathable air state is obtained.

In accordance with an aspect of the present disclosure, an indoor air pollution detecting and purifying prevention method is provided for locating air pollution in an indoor space and implementing detection, filtration and purification. The method includes: providing a plurality of gas detection devices, disposed in the indoor space for detecting the air pollution, wherein the plurality of gas detection devices detect and output air pollution data; and providing a plurality of filtration devices disposed in the indoor space, each of the plurality of filtration devices including a driver for receiving the air pollution data detected by the gas detection devices, wherein when the driver determines the air pollution data exceeding a safety detection value, the driver controls the corresponding filtration device to be enabled. The indoor space has an area divided by 10 pings to obtain a cardinal number, the cardinal number is multiplied by 13 to obtain a maximum number, and the plurality of gas detection devices are disposed in the indoor space based on the maximum number for enabling the plurality of filtration devices, thereby filtering and purifying the air pollution in the indoor space to generate a clean and safely breathable air state.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

The present disclosure will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present disclosure provides an indoor air pollution detecting and purifying prevention method is provided for locating air pollution in an indoor space and implementing detection, filtration and purification. The method includes the following steps.

Figure 1A:
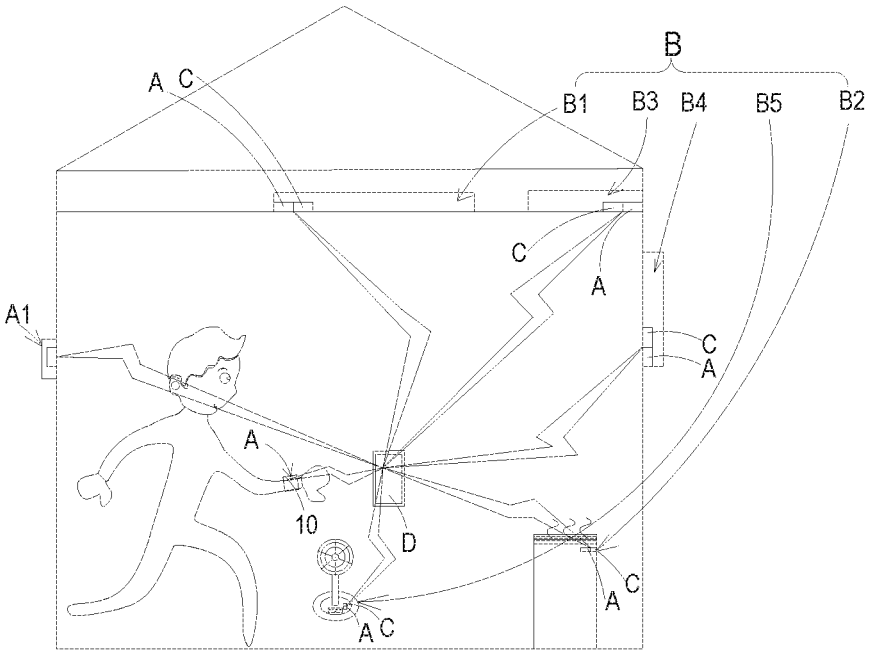
FIG. 1A is a schematic view (1) illustrating an indoor air pollution detecting and purifying prevention method implemented in an indoor space according to an embodiment of the present disclosure.

Firstly, in the step 1, a plurality of gas detection devices A are provided (as shown in FIG. 1A) and disposed in the indoor space for detecting the air pollution. In the embodiment, the plurality of gas detection devices detect and output air pollution data.

In the step 2, a plurality of filtration devices B (as shown in FIG. 1A) are provided and disposed in the indoor space. In the embodiment, each of the plurality of filtration devices B includes a driver C (as shown in FIG. 1A) for receiving the air pollution data detected by the gas detection devices A. When the driver C determines the air pollution data exceeding a safety detection value, the driver C controls the corresponding filtration device B to be enabled. Preferably but not exclusively, the gas detection device A is integrated with the driver C, so as to receive the air pollution data detected by the gas detection device A and determine if the air pollution data exceed the safety detection value.

In the embodiment, the indoor space has an area divided by 10 pings to obtain a cardinal number, the cardinal number is multiplied by 13 to obtain a maximum number, and the plurality of gas detection devices A are disposed in the indoor space based on the maximum number for enabling the plurality of filtration devices, thereby filtering and purifying the air pollution in the indoor space to reach the safety detection value and generate a clean and safely breathable air state.

In other words, the area of the indoor space is divided by 10 pings (1 ping=3.305785 $m^2$) to obtain the cardinal number, the cardinal number is multiplied by 13 to obtain a maximum number, and the plurality of gas detection devices A are disposed in the indoor space based on the maximum number. Preferably but not exclusively, in an embodiment, the cardinal number of the indoor space having the area ranged from 10 pings to 20 pings is 2, and the maximum number of the gas detection devices A disposed in the indoor space is 26. Preferably but not exclusively, in an embodiment, the cardinal number of the indoor space having the area ranged from 20 pings to 30 pings is 3, and the maximum number of the gas detection devices A disposed in the indoor space is 39. Preferably but not exclusively, in an embodiment, the cardinal number of the indoor space having the area ranged from 30 pings to 40 pings is 4, and the maximum number of the gas detection devices A disposed in the indoor space is 52. Preferably but not exclusively, in an embodiment, the cardinal number of the indoor space having the area ranged from 40 pings to 50 pings is 5, and the maximum number of the gas detection devices A disposed in the indoor space is 65. Preferably but not exclusively, in an embodiment, the cardinal number of the indoor space having the area ranged from 50 pings to 60 pings is 6, and the maximum number of the gas detection devices A disposed in the indoor space is 78. Preferably but not exclusively, in an embodiment, the cardinal number of the indoor space having the area ranged from 60 pings to 70 pings is 7, and the maximum number of the gas detection devices A disposed in the indoor space is 91. Preferably but not exclusively, in an embodiment, the cardinal number of the indoor space having the area ranged from 70 pings to 80 pings is 8, and the maximum number of the gas detection devices A disposed in the indoor space is 104. Preferably but not exclusively, in an embodiment, the cardinal number of the indoor space having the area ranged from 80 pings to 90 pings is 9, and the maximum number of the gas detection devices A disposed in the indoor space is 117. Preferably but not exclusively, in an embodiment, the cardinal number of the indoor space having the area ranged from 90 pings to 100 pings is 10, and the maximum number of the gas detection devices A disposed in the indoor space is 130. By analogy, the area of the indoor space is divided by 10 pings to obtain the cardinal number, and the cardinal number is multiplied by 13 to obtain the maximum number for disposing the plurality of gas detection devices A in the indoor space.

Figure 1B:
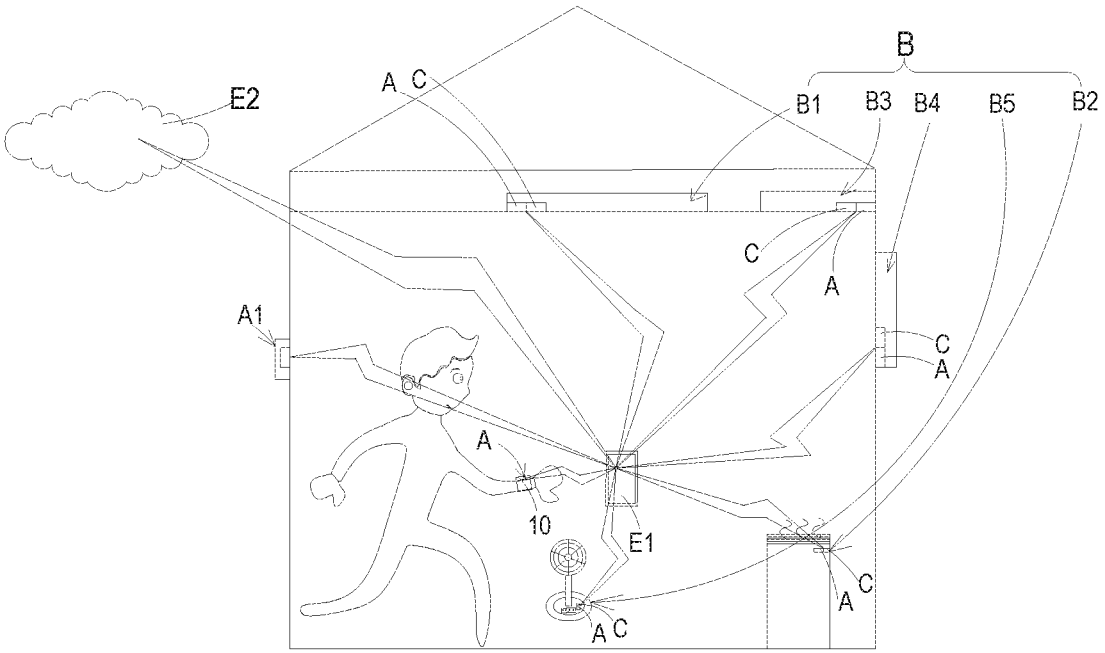
FIG. 1B is a schematic view (2) illustrating an indoor air pollution detecting and purifying prevention method implemented in an indoor space according to an embodiment of the present disclosure.

Certainly, in a specific embodiment of the present disclosure, as shown in FIG. 1A and FIG. 1B, the gas detection devices A are fixedly disposed in the indoor space, movably disposed in the indoor space, or disposed in a wearable device 10 (such as a watch or wristband), so as to detect air pollution data at any time and in real time.

In the embodiment, the air pollution is at least one selected from the group consisting of particulate matter, carbon monoxide (CO), carbon dioxide ($CO_2$), ozone ($O_3$), sulfur dioxide ($SO_2$), nitrogen dioxide ($NO_2$), lead (Pb), total volatile organic compounds (TVOC), formaldehyde (HCHO), bacteria, fungi, virus and a combination thereof.

In the embodiment, the safety detection value includes at least one selected from the group consisting of a concentration of particulate matter 2.5 ($PM_{2.5}$) which is less than 10 $\mu g/m^3$, a concentration of carbon dioxide ($CO_2$) which is less than 1000 ppm, a concentration of total volatile organic compounds (TVOC) which is less than 0.56 ppm, a concentration of formaldehyde (HCHO) which is less than 0.08 ppm, a colony-forming unit of bacteria which is less than 1500 CFU/$m^3$, a colony-forming unit of fungi which is less than 1000 CFU/$m^3$, a concentration of sulfur dioxide which is less than 0.075 ppm, a concentration of nitrogen dioxide which is less than 0.1 ppm, a concentration of carbon monoxide which is less than 9 ppm, a concentration of ozone which is less than 0.06 ppm, a concentration of lead which is less than 0.15 μg/m and a combination thereof.

Certainly, in the method of the present disclosure, a connection device is further provided. Preferably but not exclusively, the connection device includes the mobile device D of FIG. 1A, and a networking relay station E2 and a cloud database E2 of FIG. 1B, for implementing an intelligent computation. In the embodiment, the connection device receives and compares the air pollution data detected by the plurality of gas detection devices A, the intelligent computation is performed to determine a location of the air pollution in the indoor space, and a controlling instruction is intelligently and selectively issued. In the embodiment, the controlling instruction is provided and received by the drivers C of the plurality of filtration devices B, thereby the driver C controls the corresponding filtration device B to be enabled. In an embodiment, as shown in FIG. 1A, the connection device is a mobile device D. The mobile device D is directly linked to the database or big data database of the cloud device through the application program (APP) to implement the intelligent computation. The air pollution data detected by the plurality of gas detection devices A in the indoor space are received and compared for intelligently computing and determining the location of the air pollution in the indoor space, and a controlling instruction is intelligently and selectively issued. The controlling instruction is provided and received by the drivers C of the plurality of filtration devices B, so as to control the filtration devices B to be enabled. In an embodiment, as shown in FIG. 1B, the connection device is a cloud processing device. The cloud processing device includes a networking relay station E2 linked with a cloud database E2. The networking relay station E2 is directly linked to the cloud database E3 to implement the intelligent computation. The air pollution data detected by the plurality of gas detection devices A in the indoor space are received and compared for intelligently computing and determining the location of the air pollution in the indoor space, and a controlling instruction is intelligently and selectively issued. The controlling instruction is provided and received by the drivers C of the plurality of filtration devices B, so as to control the filtration devices B to be enabled. In an embodiment, the connection device receives and compares the air pollution data detected by at least three of the gas detection devices A in the indoor space for intelligently computing and determining the location of the air pollution in the indoor space based on the highest one of the air pollution data. In that, the connection device intelligently and selectively issues the controlling instruction to enable the filtration device B closest to the location of the air pollution, and then intelligently and selectively issues the controlling instruction to further enable the rest of the filtration devices B to generate a directional airflow convection, so that a flow of the air pollution is accelerated by the directional airflow convection to move toward the filtration device B closest to the location of the air pollution for being filtered and cleaned.

From the above descriptions, it can be known that the method of the present disclosure is implemented in an embodiment to dispose an effective number of gas detection devices A at the lowest cost in the indoor space, rapidly detect and locate the air pollution, and effectively control the plurality of filtration devices B to generate an intelligent airflow convection and accelerate the airflow in a desired direction(s), so that the air pollution is filtered and cleaned to the safety detection value and a clean and safely breathable air state is obtained.

Figure 2:
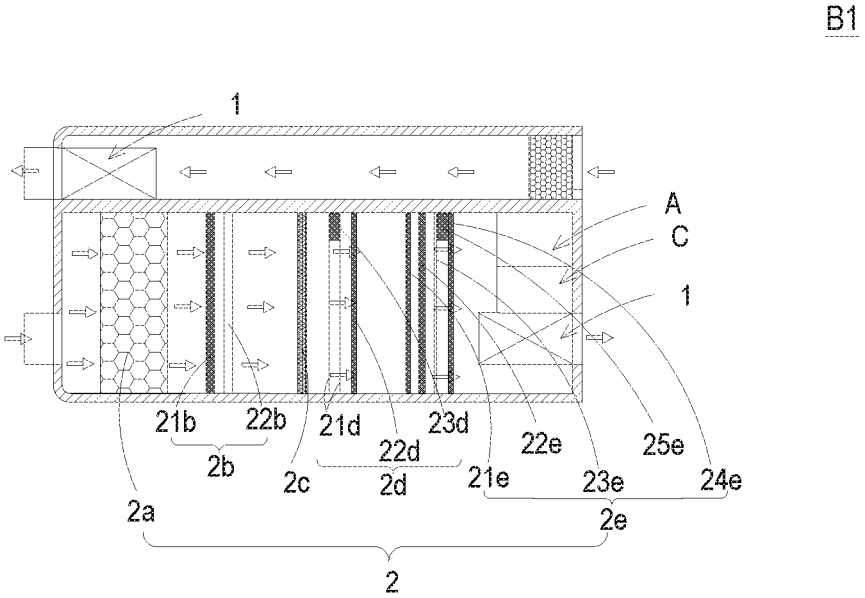
FIG. 2 is a schematic cross-sectional view illustrating a fresh air fan of the filtration device according to an embodiment of the present disclosure.
Figure 3:
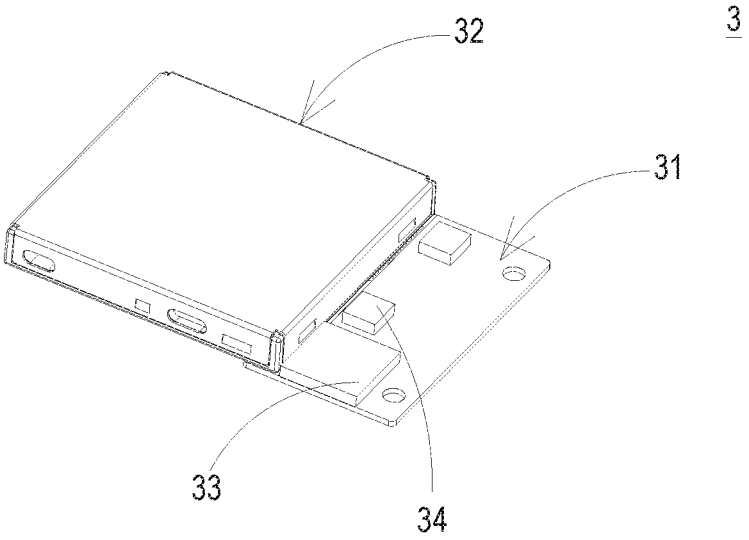
FIG. 3 is a schematic perspective view illustrating the gas detection device according to the embodiment of the present disclosure.
Figure 4A:
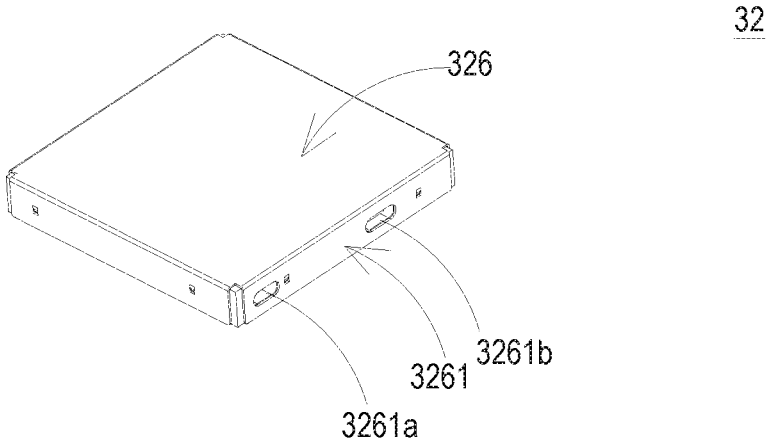
FIG. 4A is a schematic perspective view (1) illustrating the gas detection main part according to the embodiment of the present disclosure.
Figure 4B:
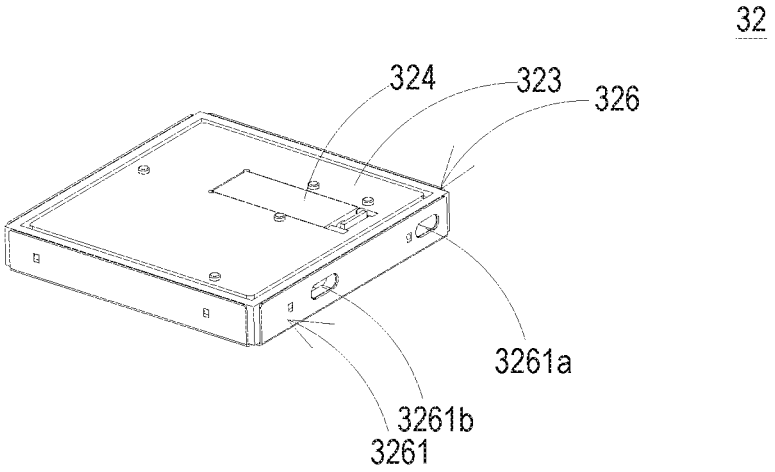
FIG. 4B is a schematic perspective view (2) illustrating the gas detection main part according to the embodiment of the present disclosure.
Figure 4C:
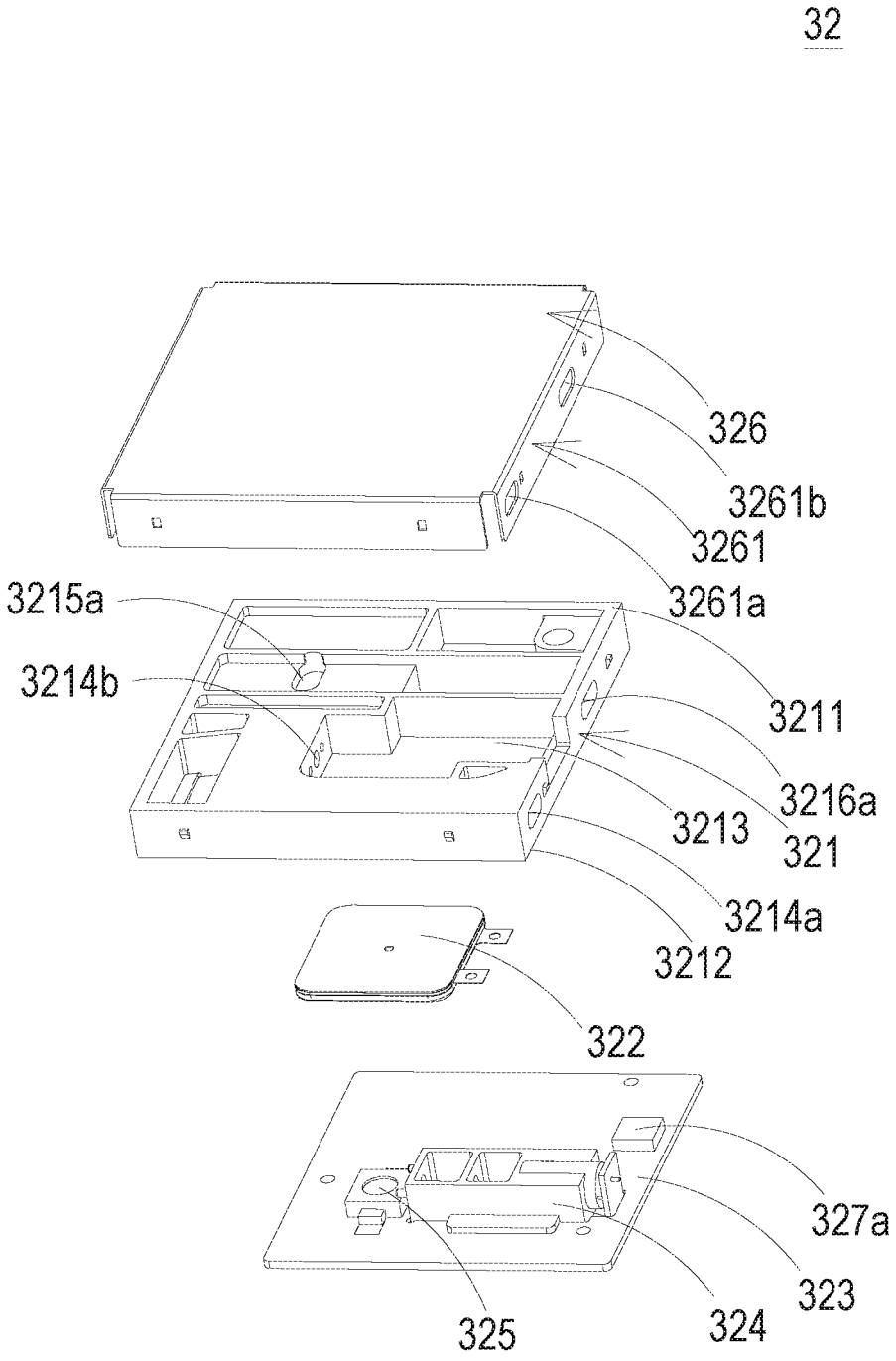
FIG. 4C is an exploded view illustrating the gas detection device according to the embodiment of the present disclosure.
Figure 5A:
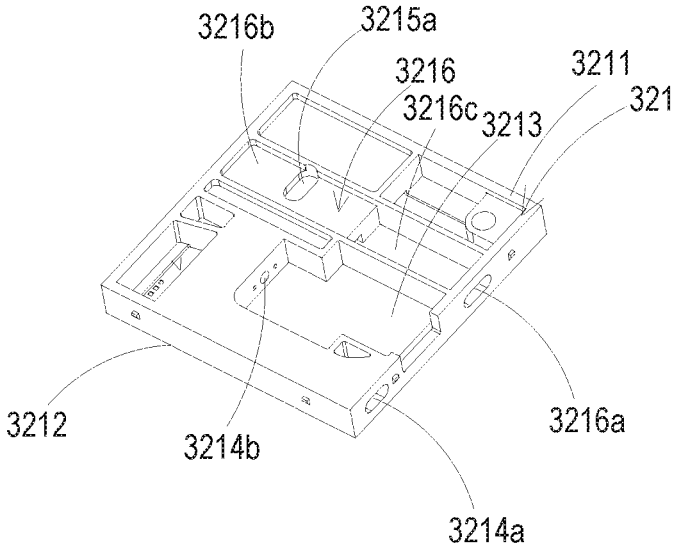
FIG. 5A is a schematic perspective view (1) illustrating the base according to the embodiment of the present disclosure.
Figure 5B:
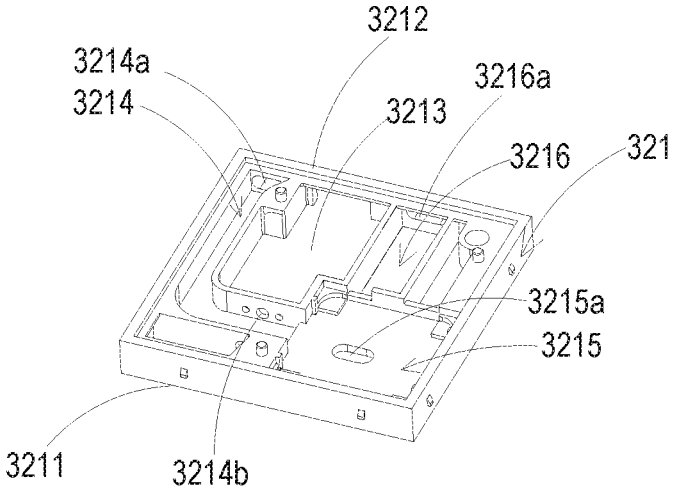
FIG. 5B is a schematic perspective view (2) illustrating the base according to the embodiment of the present disclosure.
Figure 6:
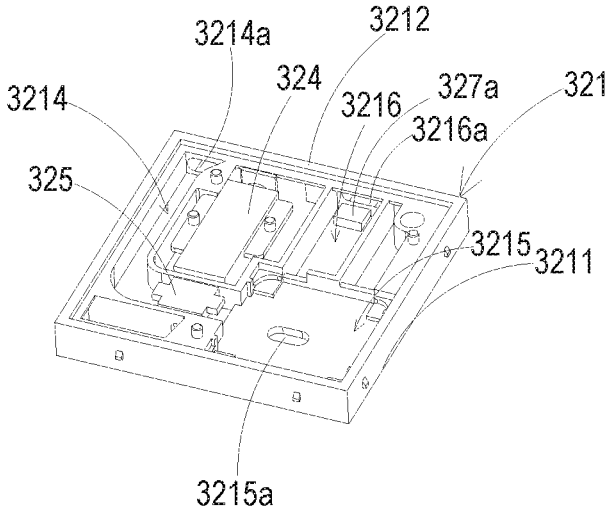
FIG. 6 is a schematic view (3) illustrating the base according to the embodiment of the present disclosure.
Figure 7A:
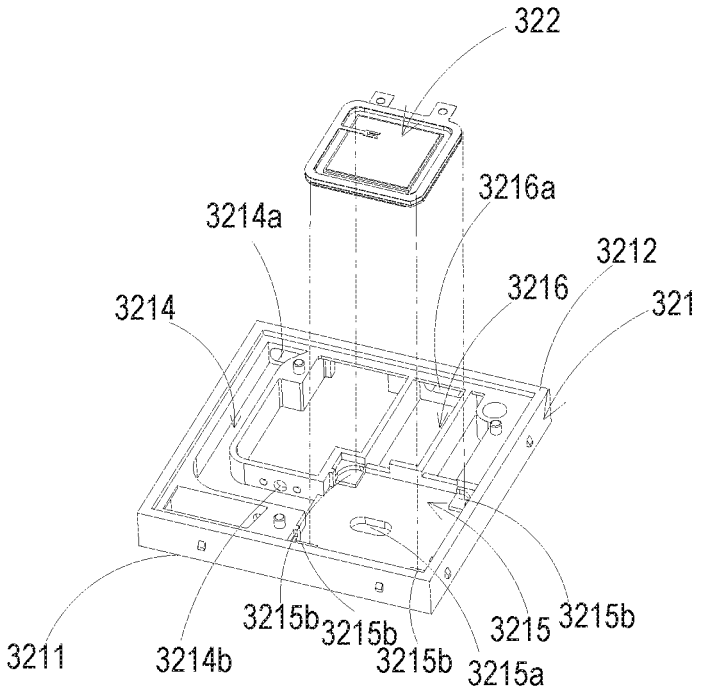
FIG. 7A is a schematic exploded view illustrating the combination of the piezoelectric actuator and the base according to the embodiment of the present disclosure.
Figure 7B:
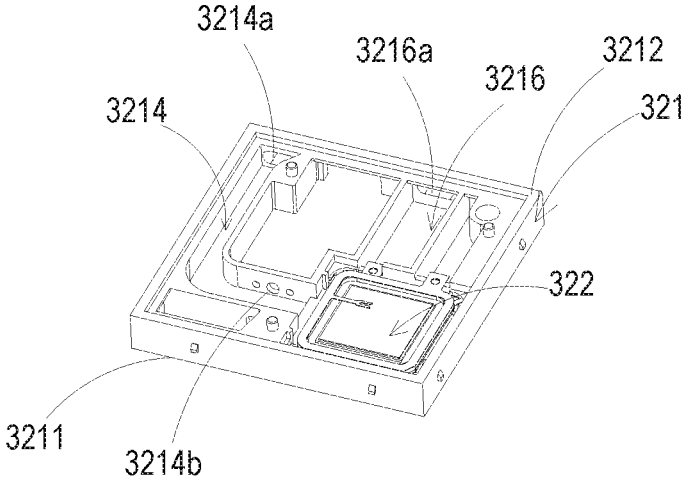
FIG. 7B is a schematic perspective view illustrating the combination of the piezoelectric actuator and the base according to the embodiment of the present disclosure.
Figure 8A:
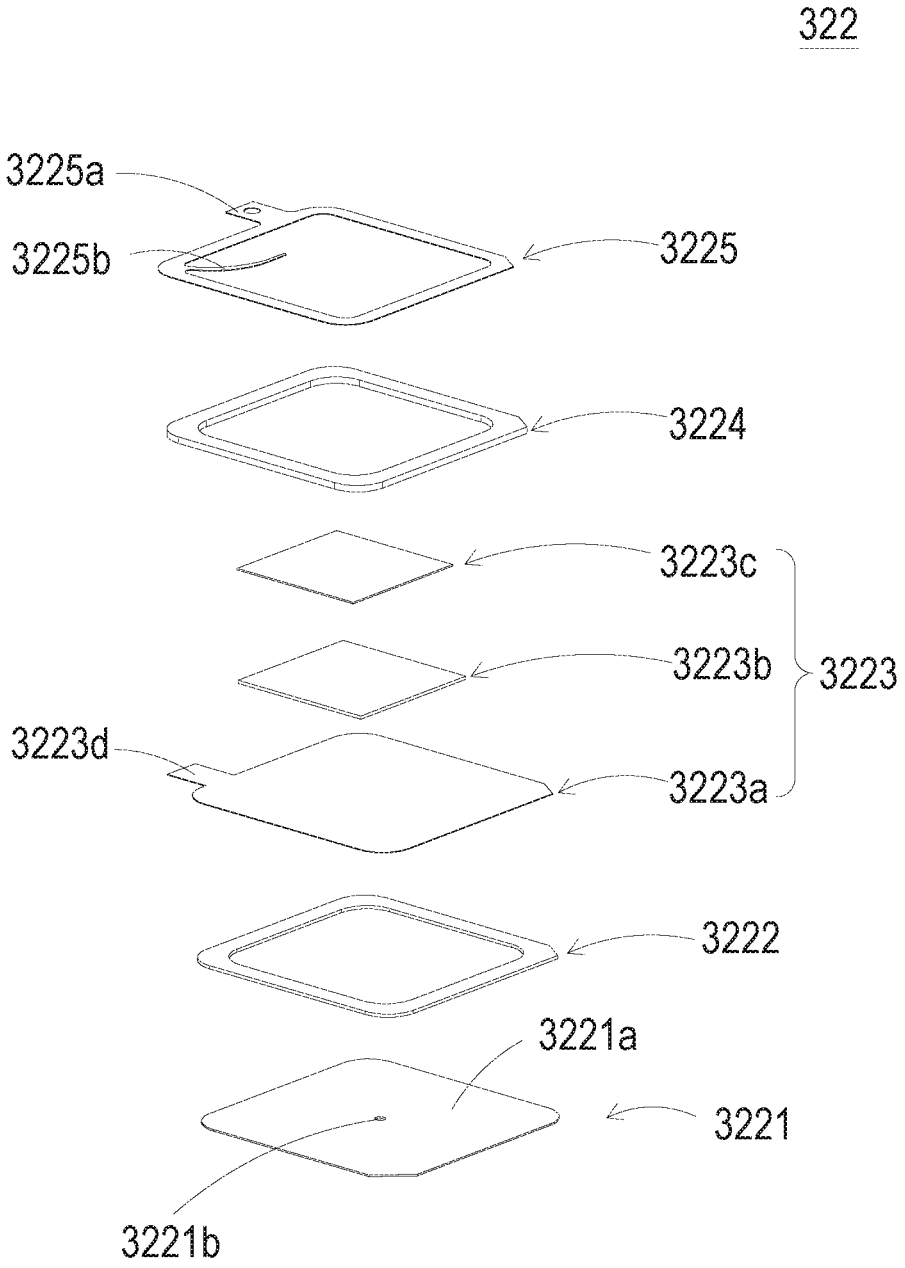
FIG. 8A is a schematic exploded view (1) illustrating the piezoelectric actuator according to the embodiment of the present disclosure.
Figure 8B:
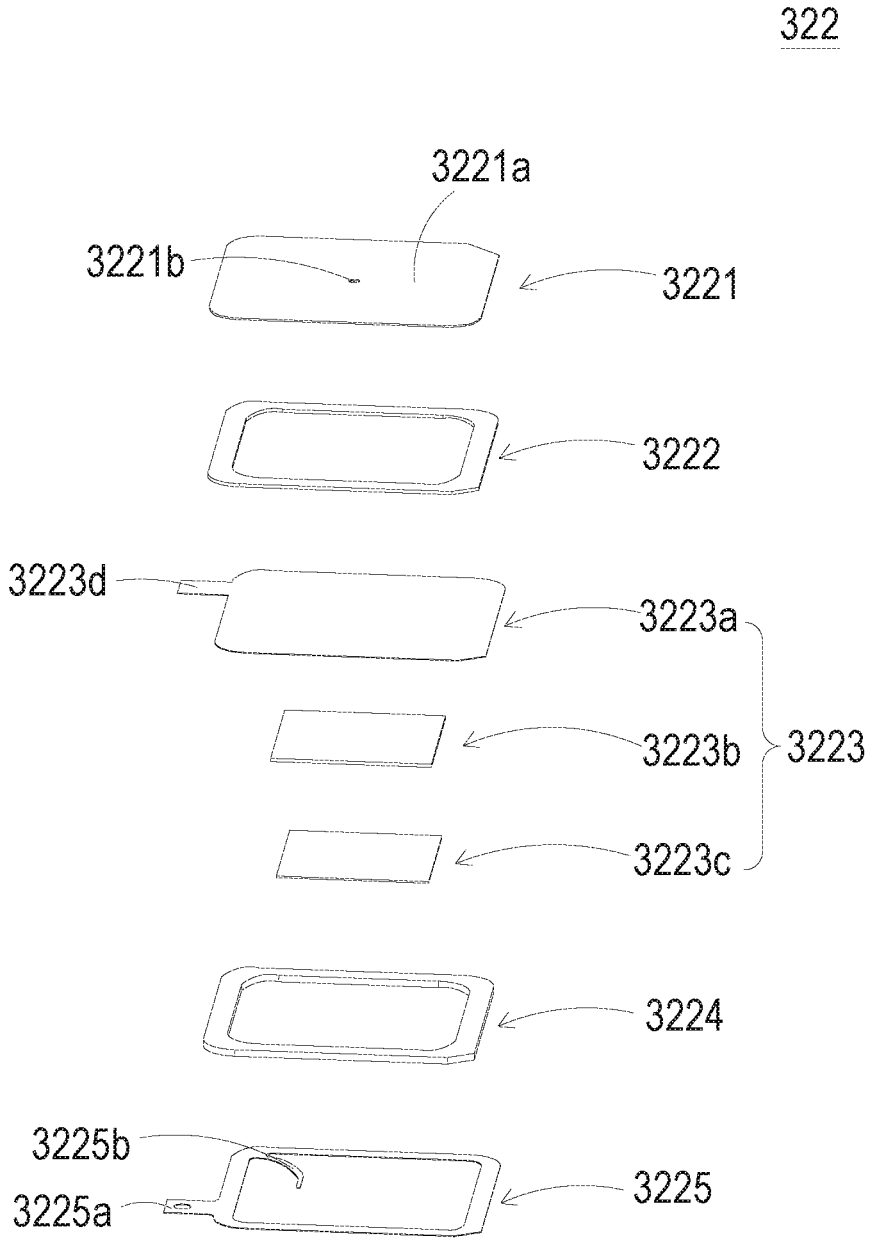
FIG. 8B is a schematic exploded view (2) illustrating the piezoelectric actuator according to the embodiment of the present disclosure.

In the embodiment, the filtration device B further includes a gas guider 1 and a filtering and purifying module 2 (as shown in FIG. 2). Preferably but not exclusively, the air pollution is transported by the gas guider 1 to pass through the filtering and purifying module 2 for filtering and purifying.

In a specific embodiment of the present disclosure, the filtration device B is a fresh air fan B1 including a gas guider 1 and a filtering and purifying module 2 (as shown in FIG. 2). The air pollution is transported by the gas guider 1 to pass through the filtering and purifying module 2 for filtering and purifying. In the embodiment, the fresh air fan B1 includes a driver C for receiving the air pollution data detected by the gas detection devices A. When the driver C determines the air pollution data exceeding a safety detection value, the driver C controls the fresh air fan B1 to be enabled. Moreover, the driver C receives the controlling instruction intelligently and selectively issued by the connection device, so as to perform an actuation operation of the gas guider 1 and control the required operation time. Thereby, the air pollution in the indoor space is transported to pass through the filtering and purifying module 2 for filtering and purifying. At the same time, the real-time clean treatment for the air pollution is provided at the location of the fresh air fan B1. In addition, the fresh air fan B1 receives the controlling instruction intelligently and selectively issued by the connection device to generate an intelligent airflow convection and accelerate the airflow in a desired direction(s), so that the air pollution is filtered and cleaned to reach the safety detection value and a clean and safely breathable air state is obtained. Moreover, in another embodiment, the fresh air fan B1 is combined with an outdoor gas detection device A1 disposed in the outdoor space for providing outdoor air pollution data, as shown in FIG. 1A and FIG. 1B. The connection device receives the outdoor air pollution data and compares the air pollution data detected by the gas detection devices A disposed in the indoor space with the outdoor air pollution data in the intelligent computation. When the outdoor air pollution data are better than the air pollution data in the indoor space, the fresh air fan B1 is allowed to receive the controlling instruction intelligently and selectively issued by the connection device, so as to perform an actuation operation of the gas guider 1 and control the required operation time. Thereby, the air pollution in the indoor space A is exchanged to the outdoor space, the real-time clean treatment for the air pollution is accelerated at the location of the fresh air fan B1, and the air pollution in the indoor space is filtered and cleared to reach the safety detection value.

Certainly, the filtration device B described below all includes a gas guider 1 and a filtering and purifying module 2 (as shown in FIG. 2). The gas guide 1 guides the air pollution to pass through the filtering and purifying module for filtering and purifying. For the convenience of explanation, the illustrations of the gas guider 1 and the filtering and purifying module 2 are omitted in the following various implementations of the filtration device B.

In a specific embodiment of the present disclosure, the filtration device B is a purifier B2. In the embodiment, the purifier B2 includes a driver C for receiving the air pollution data detected by the gas detection devices A. When the driver C determines the air pollution data exceeding a safety detection value, the driver C controls the purifier B2 to be enabled. Moreover, the driver C receives the controlling instruction intelligently and selectively issued by the connection device, so as to perform an actuation operation of the purifier B2 and control the required operation time. Thereby, the air pollution in the indoor space is transported to pass through the filtering and purifying module for filtering and purifying. At the same time, the real-time clean treatment for the air pollution is provided at the location of the purifier B2. In addition, the purifier B2 receives the controlling instruction intelligently and selectively issued by the connection device to generate an intelligent airflow convection and accelerate the airflow in a desired direction(s), so that the air pollution is filtered and cleaned to reach the safety detection value and a clean and safely breathable air state is obtained.

In a specific embodiment of the present disclosure, the filtration device B is an exhaust fan B3. In the embodiment, the exhaust fan B3 includes a driver C for receiving the air pollution data detected by the gas detection devices A. When the driver C determines the air pollution data exceeding a safety detection value, the driver C controls the exhaust fan B3 to be enabled. Moreover, the driver C receives the controlling instruction intelligently and selectively issued by the connection device, so as to perform an actuation operation of the exhaust fan B3 and control the required operation time. Thereby, the air pollution in the indoor space is transported to pass through the filtering and purifying module for filtering and purifying. At the same time, the real-time clean treatment for the air pollution is provided at the location of the exhaust fan B3. In addition, the exhaust fan B3 receives the controlling instruction intelligently and selectively issued by the connection device to generate an intelligent airflow convection and accelerate the airflow in a desired direction(s), so that the air pollution is filtered and cleaned to reach the safety detection value and a clean and safely breathable air state is obtained.

In a specific embodiment of the present disclosure, the filtration device B is a range hood B4. In the embodiment, the range hood B4 includes a driver C for receiving the air pollution data detected by the gas detection devices A. When the driver C determines the air pollution data exceeding a safety detection value, the driver C controls the range hood B4 to be enabled. Moreover, the driver C receives the controlling instruction intelligently and selectively issued by the connection device, so as to perform an actuation operation of the range hood B4 and control the required operation time. Thereby, the air pollution in the indoor space is transported to pass through the filtering and purifying module for filtering and purifying. At the same time, the real-time clean treatment for the air pollution is provided at the location of the range hood B4. In addition, the range hood B4 receives the controlling instruction intelligently and selectively issued by the connection device to generate an intelligent airflow convection and accelerate the airflow in a desired direction(s), so that the air pollution is filtered and cleaned to reach the safety detection value and a clean and safely breathable air state is obtained.

In a specific embodiment of the present disclosure, the filtration device B is an electric fan B5. In the embodiment, the electric fan B5 includes a driver C for receiving the air pollution data detected by the gas detection devices A. When the driver C determines the air pollution data exceeding a safety detection value, the driver C controls the electric fan B5 to be enabled. Moreover, the driver C receives the controlling instruction intelligently and selectively issued by the connection device, so as to perform an actuation operation of the electric fan B5 and control the required operation time. Thereby, the air pollution in the indoor space is transported to pass through the filtering and purifying module for filtering and purifying. At the same time, the real-time clean treatment for the air pollution is provided at the location of the electric fan B5. In addition, the electric fan B5 receives the controlling instruction intelligently and selectively issued by the connection device to generate an intelligent airflow convection and accelerate the airflow in a desired direction(s), so that the air pollution is filtered and cleaned to reach the safety detection value and a clean and safely breathable air state is obtained.

In the embodiment, the filtering and purifying module 2 includes a combination of various implementations. Preferably but not exclusively, the filtering and purifying module 2 is a high efficiency particulate air (HEPA) filter screen 2*a*, which is configured to absorb the chemical smoke, the bacteria, the dust particles and the pollen contained in the gas, so that the gas introduced into the HEPA filter screen 2*a* is filtered and purified to achieve the effect of filtering and purification. In some embodiments, the HEPA filter screen 2*a* is coated by a cleansing factor containing chlorine dioxide layer, which is configured to inhibit viruses, bacteria, fungi, influenza A, influenza B, enterovirus and norovirus in the gas, and the inhibition ratio can reach 99%, thereby reducing the cross-infection of viruses. In some embodiments, the HEPA filter screen 2*a* is coated by an herbal protective layer, which is configured to resist allergy effectively and destroy a surface protein of influenza virus (H1N1) in the gas passing through the HEPA filter screen 2*a*. In some embodiments, the HEPA filter screen 2*a* is coated by a silver ion, which is configured to inhibit viruses, bacteria and fungi contained in the gas.

In another embodiment, the filtering and purifying module 2 is a high efficiency particulate air (HEPA) filter screen 2*a* combined with a photo-catalyst unit 2*b*. The photo-catalyst unit 2*b* includes a photo catalyst 21*b* and an ultraviolet lamp 22*b*. When the photo catalyst 21*b* is irradiated by the ultraviolet lamp 22*b*, the light energy is converted into the chemical energy to decompose harmful substances contained in the gas and disinfect bacteria contained in the gas, so as to achieve the effects of filtering and purifying.

In another embodiment, the filtering and purifying module 2 is a high efficiency particulate air (HEPA) filter screen 2*a* combined with a photo-plasma unit 2*c*. The photo-plasma unit 2*c* includes a nanometer irradiation tube. When the gas is irradiated by the nanometer irradiation tube, oxygen molecules and water molecules contained in the gas are decomposed into high oxidizing photo-plasma to generate an ion flow capable of destroying organic molecules, so that volatile formaldehyde, volatile toluene and volatile organic compounds (VOC) contained in the gas are decomposed into water and carbon dioxide, so as to achieve the effects of filtering and purifying.

In another embodiment, the filtering and purifying module 2 is a high efficiency particulate air (HEPA) filter screen 2*a* combined with a negative ion unit 2*d*. The negative ionizer 2*d* includes at least one electrode wire 21*d*, at least one dust collecting plate 22*d* and a boost power supply device 23*d*. When a high voltage is provided by the boost power supply device 23*d* and discharged through the electrode wire 21*d*, the suspended particles contained in the gas introduced are attached to the dust collecting plate 22*d*, so as to filter the introduced gas and achieve the effects of filtering and purifying.

In another embodiment, the filtering and purifying module 2 is a high efficiency particulate air (HEPA) filter screen 2*a* combined with a plasma ion unit 2*e*. The plasma ion unit 2*e* includes a first electric-field protection screen 21*e*, an adsorption filter screen 22*e*, a high-voltage discharge electrode 23*e*, a second electric-field protection screen 24*e* and a boost power supply device 25*e*. The boost power supply device 25*e* provides a high voltage to the high-voltage discharge electrode 23*e* to discharge and form a high-voltage plasma column with plasma ion, so as to decompose viruses or bacteria contained in the gas introduced by the plasma ion. In the embodiment, the adsorption filter screen 22*e* and the high-voltage discharge electrode 23*e* are located between the first electric-field protection screen 21*e* and the second electric-field protection screen 24*e*. As the high-voltage discharge electrode 23*e* is provided with a high voltage by the boost power supply 25*e*, a high-voltage plasma column with plasma ion is formed. When the gas is introduced, oxygen molecules and water molecules contained in the gas are decomposed into positive hydrogen ions ($H^+$) and negative oxygen ions ($O^{2-}$) by the plasma ion. The substances attached with water around the ions are adhered on the surface of viruses and bacteria and converted into OH radicals with extremely strong oxidizing power, thereby removing hydrogen (H) from the protein on the surface of viruses and bacteria, and thus decomposing (oxidizing) the protein, so as to filter the introduced gas and achieve the effects of filtering and purifying.

In another embodiment, the filtering and purifying module 2 is a combination of an activated carbon and a high efficiency particulate air (HEPA) filter screen 2*a* and a zeolite screen. The zeolite screen is configured to filter and absorb the volatile organic compounds (VOC), and the HEPA filter screen 2*a* is configured to absorb the chemical smoke, bacteria, dust particles and pollen contained in the gas, so as to filter the introduced gas and achieve the effects of filtering and purifying.

In order to elucidate the operation of the method of the present disclosure, the structure of the gas detection device A of the present disclosure is described in detail as follows.

Please refer to FIG. 3 to FIG. 11. The gas detection device A of the present disclosure is represented by the gas detection device 3 in the following descriptions. In the embodiment, the gas detection device 3 includes a controlling circuit board 31, a gas detection main part 32, a microprocessor 33 and a communicator 34. In the embodiment, the gas detection main part 32, the microprocessor 33 and the communicator 34 are integrally packaged on the controlling circuit board 31 and electrically connected to the controlling circuit board 31. The microprocessor 33 and the communicator 34 are disposed on the controlling circuit board 31, and the microprocessor 33 controls the detection of the gas detection main part 32. In that, the gas detection main part 32 detects the at least one microorganism and outputs a detection signal, and the microprocessor receives and processes the detection signal to generate microorganism data and provides the microorganism data to the communicator 34 for a wireless communication transmission externally. Preferably but not exclusively, the wireless communication transmission is one selected from the group consisting of a Wi-Fi communication transmission, a Bluetooth communication transmission, a radio frequency identification communication transmission and a near field communication (NFC) transmission.

Please refer to FIG. 4A to FIG. 9A. In the embodiment, the gas detection main part 32 includes a base 321, a piezoelectric actuator 322, a driving circuit board 323, a laser component 324, a particulate sensor 325 and an outer cover 326. In the embodiment, the base 321 includes a first surface 3211, a second surface 3212, a laser loading region 3213, a gas-inlet groove 3214, a gas-guiding-component loading region 3215 and a gas-outlet groove 3216. The first surface 3211 and the second surface 3212 are two surfaces opposite to each other. In the embodiment, the laser loading region 3213 for the laser component 324 is hollowed out from the first surface 3211 toward the second surface 3212. The outer cover 326 covers the base 321 and includes a side plate 3261. The side plate 3261 has an inlet opening 3261*a* and an outlet opening 3261*b*. The gas-inlet groove 3214 is concavely formed from the second surface 3212 and disposed adjacent to the laser loading region 3213. The gas-inlet groove 3214 includes a gas-inlet 3214*a* and two lateral walls. The gas-inlet 3214*a* is in communication with an environment outside the base 321, and is spatially corresponding in position to an inlet opening 3261*a* of the outer cover 326. Two transparent windows 3214*b* are opened on the two lateral walls of the gas-inlet groove 3214 and are in communication with the laser loading region 3213. Therefore, the first surface 3211 of the base 321 is covered and attached by the outer cover 326, and the second surface 3212 is covered and attached by the driving circuit board 323, so that an inlet path is defined by the gas-inlet groove 3214.

In the embodiment, the gas-guiding-component loading region 3215 mentioned above is concavely formed from the second surface 3212 and in communication with the gas-inlet groove 3214. A ventilation hole 3215*a* penetrates a bottom surface of the gas-guiding-component loading region 3215. The gas-guiding-component loading region 3215 includes four positioning protrusions 3215*b* disposed at four corners of the gas-guiding-component loading region 3215, respectively. In the embodiment, the gas-outlet groove 3216 includes a gas-outlet 3216*a*, and the gas-outlet 3216*a* is spatially corresponding to the outlet opening 3261*b* of the outer cover 326. The gas-outlet groove 3216 includes a first section 3216*b* and a second section 3216*c*. The first section 3216*b* is concavely formed out from the first surface 3211 in a region spatially corresponding to a vertical projection area of the gas-guiding-component loading region 3215. The second section 3216*c* is hollowed out from the first surface 3211 to the second surface 3212 in a region where the first surface 3211 is extended from the vertical projection area of the gas-guiding-component loading region 3215. The first section 3216*b* and the second section 3216*c* are connected to form a stepped structure. Moreover, the first section 3216*b* of the gas-outlet groove 3216 is in communication with the ventilation hole 3215*a* of the gas-guiding-component loading region 3215, and the second section 3216*c* of the gas-outlet groove 3216 is in communication with the gas-outlet 3216*a*. In that, when first surface 3211 of the base 321 is attached and covered by the outer cover 326 and the second surface 3212 of the base 321 is attached and covered by the driving circuit board 323, the gas-outlet groove 3216 and the driving circuit board 323 collaboratively define an outlet path.

In the embodiment, the laser component 324 and the particulate sensor 325 are disposed on and electrically connected to the driving circuit board 323 and located within the base 321. In order to clearly describe and illustrate the positions of the laser component 324 and the particulate sensor 325 in the base 321, the driving circuit board 323 is intentionally omitted. The laser component 324 is accommodated in the laser loading region 3213 of the base 321, and the particulate sensor 325 is accommodated in the gas-inlet groove 3214 of the base 321 and is aligned to the laser component 324. In addition, the laser component 324 is spatially corresponding to the transparent window 3214*b*.

Therefore, a light beam emitted by the laser component 324 passes through the transparent window 3214*b* and is irradiated into the gas-inlet groove 3214. A light beam path from the laser component 324 passes through the transparent window 3214*b* and extends in an orthogonal direction perpendicular to the gas-inlet groove 3214. Preferably but not exclusively, the particulate sensor 325 is used for detecting the suspended particulate information. In the embodiment, a projecting light beam emitted from the laser component 324 passes through the transparent window 3214*b* and enters the gas-inlet groove 3214 to irradiate the suspended particles contained in the gas passing through the gas-inlet groove 3214. When the suspended particles contained in the gas are irradiated and generate scattered light spots, the scattered light spots are received and calculated by the particulate sensor 325 to obtain the gas detection information. In the embodiment, a gas sensor 327*a* is positioned and disposed on the driving circuit board 323, electrically connected to the driving circuit board 323, and accommodated in the gas-outlet groove 3216, so as to detect the microorganism introduced into the gas-outlet groove 3216. Preferably but not exclusively, in an embodiment, the gas sensor 327*a* includes a volatile-organic-compound sensor for detecting the gas information of carbon dioxide ($CO_2$) or volatile organic compounds (TVOC). Preferably but not exclusively, in an embodiment, the gas sensor 327*a* includes a formaldehyde sensor for detecting the gas information of formaldehyde (HCHO). Preferably but not exclusively, in an embodiment, the gas sensor 327*a* includes a bacteria sensor for detecting the gas information of bacteria or fungi. Preferably but not exclusively, in an embodiment, the gas sensor 327*a* includes a virus sensor for detecting the gas information of virus.

In the embodiment, the piezoelectric actuator 322 is accommodated in the square-shaped gas-guiding-component loading region 3215 of the base 321. In addition, the gas-guiding-component loading region 3215 of the base 321 is in fluid communication with the gas-inlet groove 3214. When the piezoelectric actuator 322 is enabled, the gas in the gas-inlet 3214 is inhaled into the piezoelectric actuator 322, flows through the ventilation hole 3215*a* of the gas-guiding-component loading region 3215 into the gas-outlet groove 3216. Moreover, the driving circuit board 323 covers the second surface 3212 of the base 321, and the laser component 324 is positioned and disposed on the driving circuit board 323, and is electrically connected to the driving circuit board 323. The particulate sensor 325 is also positioned and disposed on the driving circuit board 323, and is electrically connected to the driving circuit board 323. In that, when the outer cover 326 covers the base 321, the inlet opening 3261*a* is spatially corresponding to the gas-inlet 3214*a* of the base 321, and the outlet opening 3261*b* is spatially corresponding to the gas-outlet 3216*a* of the base 321.

In the embodiment, the piezoelectric actuator 322 includes a gas-injection plate 3221, a chamber frame 3222, an actuator element 3223, an insulation frame 3224 and a conductive frame 3225. In the embodiment, the gas-injection plate 3221 is made by a flexible material and includes a suspension plate 3221*a* and a hollow aperture 3221*b*. The suspension plate 3221*a* is a sheet structure and is permitted to undergo a bending deformation. Preferably but not exclusively, the shape and the size of the suspension plate 3221*a* are accommodated in the inner edge of the gas-guiding-component loading region 3215, but not limited thereto. The hollow aperture 3221*b* passes through a center of the suspension plate 3221*a*, so as to allow the gas to flow therethrough. Preferably but not exclusively, in the embodiment, the shape of the suspension plate 3221*a* is selected from the group consisting of a square, a circle, an ellipse, a triangle and a polygon, but not limited thereto.

In the embodiment, the chamber frame 3222 is carried and stacked on the gas-injection plate 3221. In addition, the shape of the chamber frame 3222 is corresponding to the gas-injection plate 3221. The actuator element 3223 is carried and stacked on the chamber frame 3222. A resonance chamber 3226 is collaboratively defined by the actuator element 3223, the chamber frame 3222 and the suspension plate 3221*a* and is formed between the actuator element 3223, the chamber frame 3222 and the suspension plate 3221*a*. The insulation frame 3224 is carried and stacked on the actuator element 3223 and the appearance of the insulation frame 3224 is similar to that of the chamber frame 3222. The conductive frame 3225 is carried and stacked on the insulation frame 3224, and the appearance of the conductive frame 3225 is similar to that of the insulation frame 3224. In addition, the conductive frame 3225 includes a conducting pin 3225*a* and a conducting electrode 3225*b*. The conducting pin 3225*a* is extended outwardly from an outer edge of the conductive frame 3225, and the conducting electrode 3225*b* is extended inwardly from an inner edge of the conductive frame 3225. Moreover, the actuator element 3223 further includes a piezoelectric carrying plate 3223*a*, an adjusting resonance plate 3223*b* and a piezoelectric plate 3223*c*. The piezoelectric carrying plate 3223*a* is carried and stacked on the chamber frame 3222. The adjusting resonance plate 3223*b* is carried and stacked on the piezoelectric carrying plate 3223*a*. The piezoelectric plate 3223*c* is carried and stacked on the adjusting resonance plate 3223*b*. The adjusting resonance plate 3223*b* and the piezoelectric plate 3223*c* are accommodated in the insulation frame 3224. The conducting electrode 3225*b* of the conductive frame 3225 is electrically connected to the piezoelectric plate 3223*c*. In the embodiment, the piezoelectric carrying plate 3223*a* and the adjusting resonance plate 3223*b* are made by a conductive material. The piezoelectric carrying plate 3223*a* includes a piezoelectric pin 3223*d*. The piezoelectric pin 3223*d* and the conducting pin 3225*a* are electrically connected to a driving circuit (not shown) of the driving circuit board 323, so as to receive a driving signal, such as a driving frequency and a driving voltage. Through this structure, a circuit is formed by the piezoelectric pin 3223*d*, the piezoelectric carrying plate 3223*a*, the adjusting resonance plate 3223*b*, the piezoelectric plate 3223*c*, the conducting electrode 3225*b*, the conductive frame 3225 and the conducting pin 3225*a* for transmitting the driving signal. Moreover, the insulation frame 3224 is insulated between the conductive frame 3225 and the actuator element 3223, so as to avoid the occurrence of a short circuit. Thereby, the driving signal is transmitted to the piezoelectric plate 3223*c*. After receiving the driving signal such as the driving frequency and the driving voltage, the piezoelectric plate 3223*c* deforms due to the piezoelectric effect, and the piezoelectric carrying plate 3223*a* and the adjusting resonance plate 3223*b* are further driven to generate the bending deformation in the reciprocating manner.

Furthermore, in the embodiment, the adjusting resonance plate 3223*b* is located between the piezoelectric plate 3223*c* and the piezoelectric carrying plate 3223*a* and served as a cushion between the piezoelectric plate 3223*c* and the piezoelectric carrying plate 3223*a*. Thereby, the vibration frequency of the piezoelectric carrying plate 3223*a* is adjustable. Basically, the thickness of the adjusting resonance plate 3223*b* is greater than the thickness of the piezoelectric carrying plate 3223*a*, and the vibration frequency of the actuator element 3223 can be adjusted by adjusting the thickness of the adjusting resonance plate 3223*b*.

Please refer to FIG. 7A, FIG. 7B, FIG. 8A, FIG. 8B and FIG. 9A. In the embodiment, the gas-injection plate 3221, the chamber frame 3222, the actuator element 3223, the insulation frame 3224 and the conductive frame 3225 are stacked and positioned in the gas-guiding-component loading region 3215 sequentially, so that the piezoelectric actuator 322 is supported and positioned in the gas-guiding-component loading region 3215. A plurality of clearances 3221*c* are defined between the suspension plate 3221*a* of the gas-injection plate 3221 and an inner edge of the gas-guiding-component loading region 3215 for gas flowing therethrough. In the embodiment, a flowing chamber 3227 is formed between the gas-injection plate 3221 and the bottom surface of the gas-guiding-component loading region 3215. The flowing chamber 3227 is in communication with the resonance chamber 3226 between the actuator element 3223, the chamber frame 3222 and the suspension plate 3221*a* through the hollow aperture 3221*b* of the gas-injection plate 3221. By controlling the vibration frequency of the gas in the resonance chamber 3226 to be close to the vibration frequency of the suspension plate 3221*a*, the Helmholtz resonance effect is generated between the resonance chamber 3226 and the suspension plate 3221*a*, so as to improve the efficiency of gas transportation. When the piezoelectric plate 3223*c* is moved away from the bottom surface of the gas-guiding-component loading region 3215, the suspension plate 3221*a* of the gas-injection plate 3221 is driven to move away from the bottom surface of the gas-guiding-component loading region 3215 by the piezoelectric plate 3223*c*. In that, the volume of the flowing chamber 3227 is expanded rapidly, the internal pressure of the flowing chamber 3227 is decreased to form a negative pressure, and the gas outside the piezoelectric actuator 322 is inhaled through the clearances 3221*c* and enters the resonance chamber 3226 through the hollow aperture 3221*b*. Consequently, the pressure in the resonance chamber 3226 is increased to generate a pressure gradient. When the suspension plate 3221*a* of the gas-injection plate 3221 is driven by the piezoelectric plate 3223*c* to move toward the bottom surface of the gas-guiding-component loading region 3215, the gas in the resonance chamber 3226 is discharged out rapidly through the hollow aperture 3221*b*, and the gas in the flowing chamber 3227 is compressed, thereby the converged gas is rapidly and massively ejected out of the flowing chamber 3227 under the condition close to an ideal gas state of the Benulli's law, and transported to the ventilation hole 3215*a* of the gas-guiding-component loading region 3215.

Figure 9A:
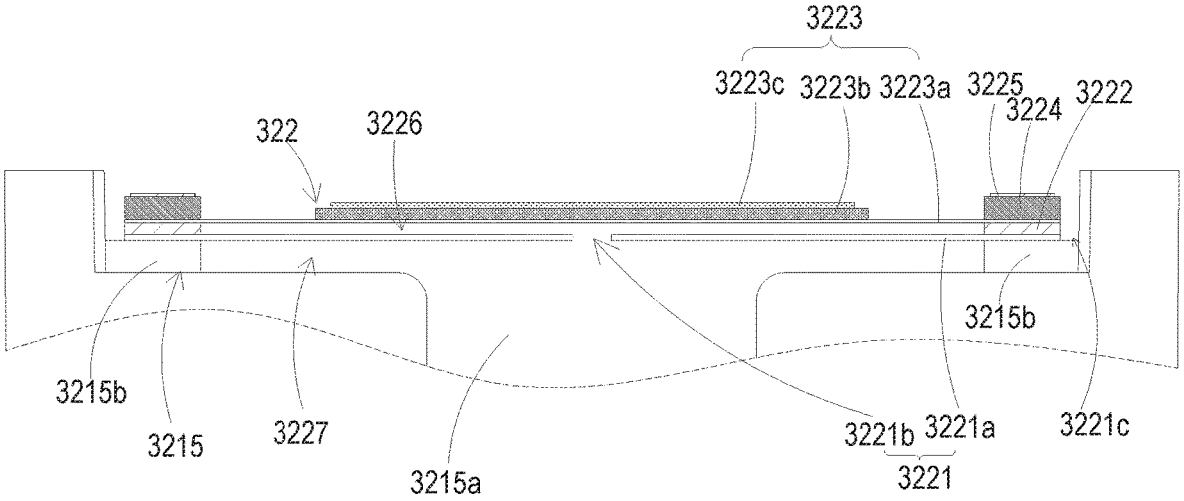
FIG. 9A is a schematic cross-sectional view (1) illustrating an action of the piezoelectric actuator according to the embodiment of the present disclosure.
Figure 9B:
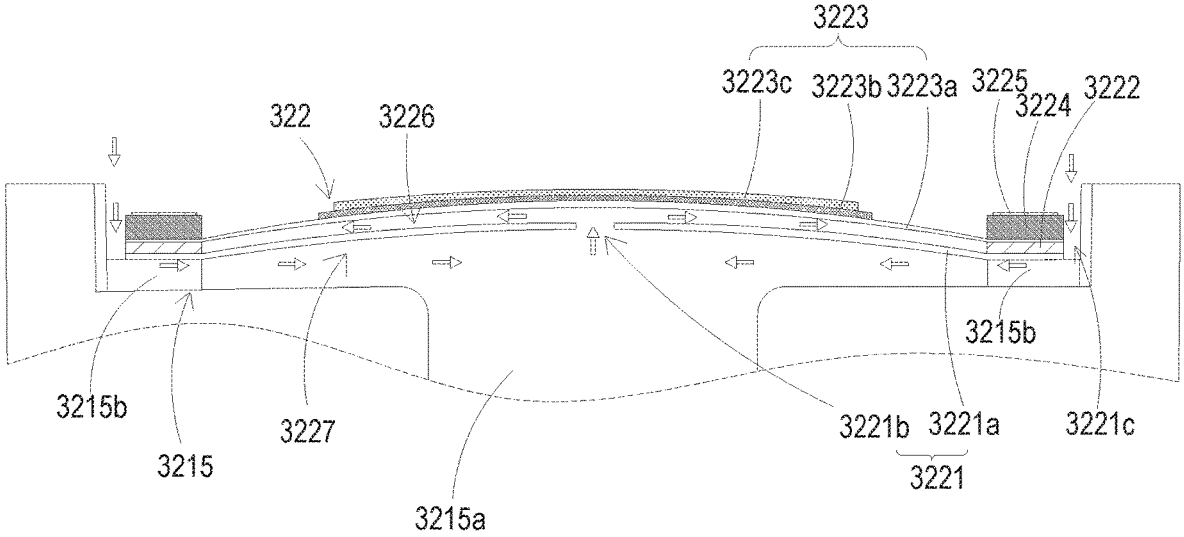
FIG. 9B is a schematic cross-sectional view (2) illustrating of the piezoelectric actuator according to the embodiment of the present disclosure.
Figure 9C:
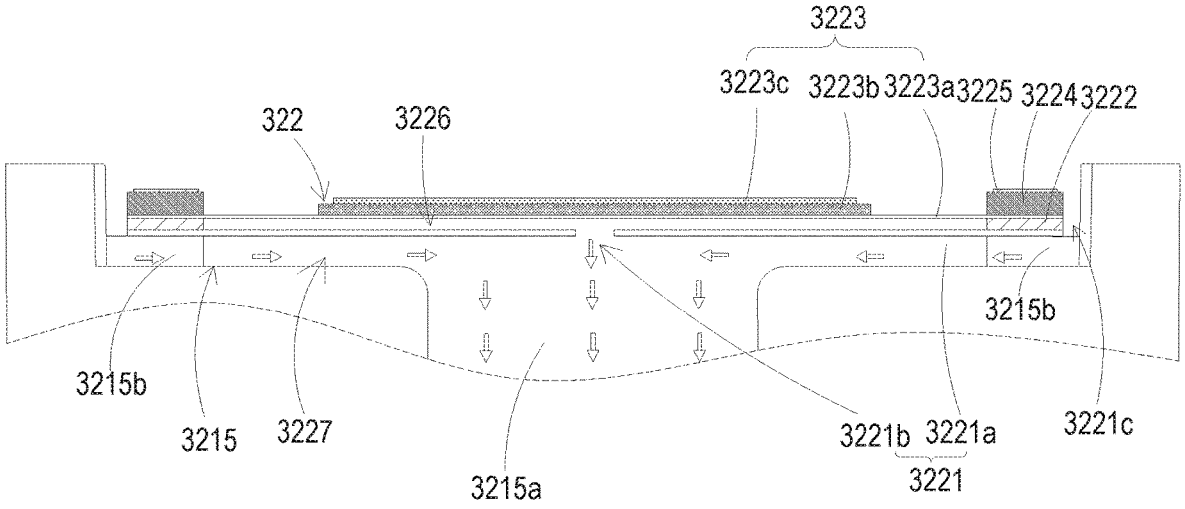
FIG. 9C is a schematic cross-sectional view (3) illustrating an action of the piezoelectric actuator of the central controller according to the embodiment of the present disclosure.
Figure 10A:
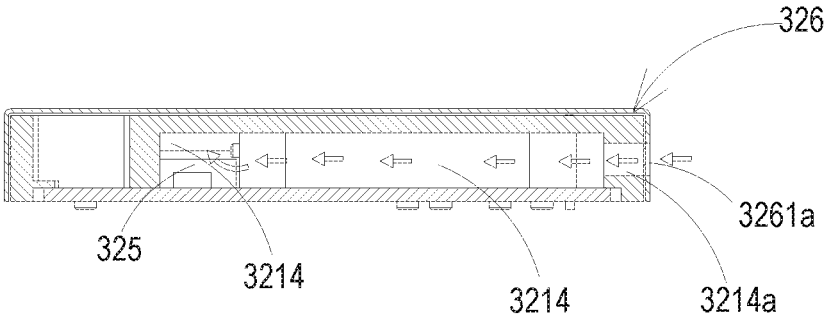
FIG. 10A is a schematic cross-sectional view (1) illustrating the gas detection main part according to the embodiment of the present disclosure.
Figure 10B:
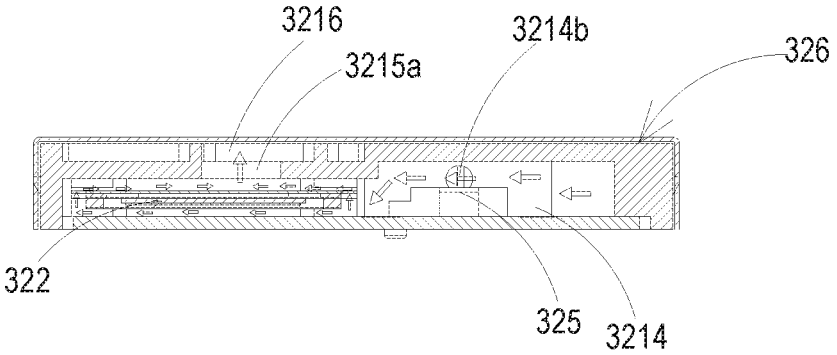
FIG. 10B is a schematic cross-sectional view (2) illustrating the gas detection main part according to the embodiment of the present disclosure.
Figure 10C:
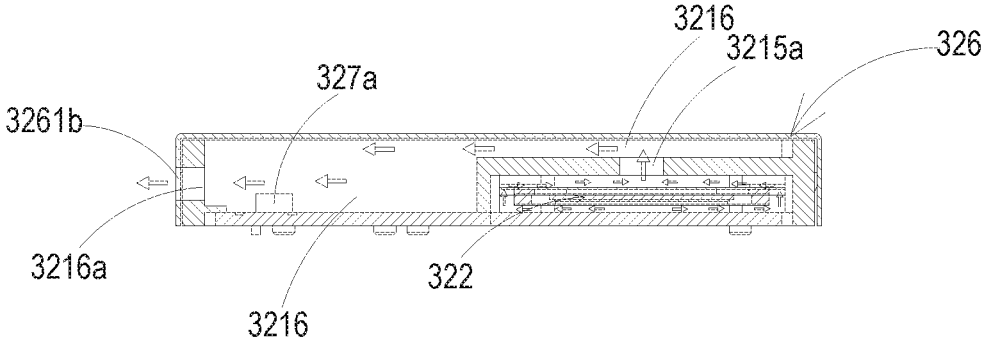
FIG. 10C is a schematic cross-sectional view (3) illustrating the gas detection main part according to the embodiment of the present disclosure.
Figure 11:
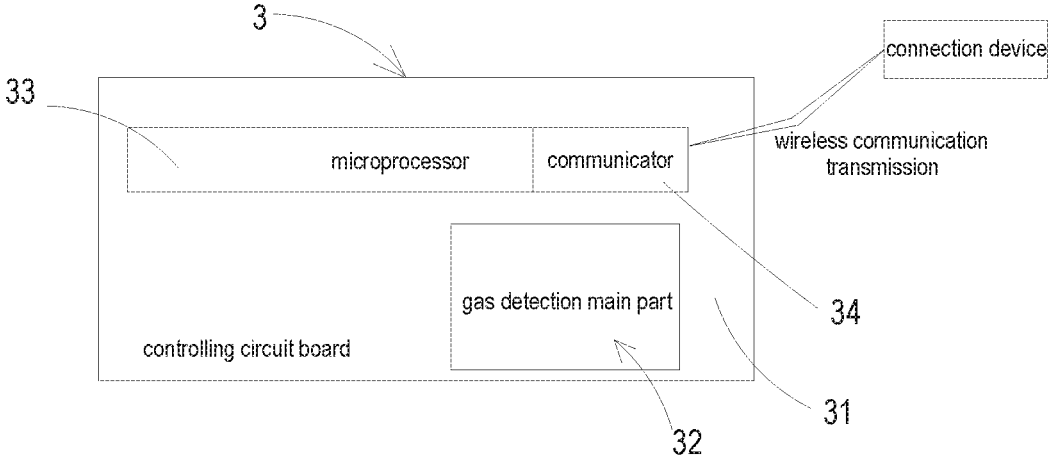
FIG. 11 is a block diagram showing the signal transmission of the gas detection device according to the embodiment of the present disclosure.

By repeating the above operation steps shown in FIG. 9B and FIG. 9C, the piezoelectric plate 3223*c* is driven to generate the bending deformation in a reciprocating manner. According to the principle of inertia, since the gas pressure inside the resonance chamber 3226 is lower than the equilibrium gas pressure after the converged gas is ejected out, the gas is introduced into the resonance chamber 3226 again. Moreover, the vibration frequency of the gas in the resonance chamber 3226 is controlled to be close to the vibration frequency of the piezoelectric plate 3223*c*, so as to generate the Helmholtz resonance effect to achieve the gas transportation at high speed and in large quantities. The gas is inhaled through the inlet opening 3261*a* of the outer cover 326, flows into the gas-inlet groove 3214 of the base 321 through the gas-inlet 3214*a*, and is transported to the position of the particulate sensor 325. The piezoelectric actuator 322 is enabled continuously to inhale the gas into the inlet path, and facilitate the gas outside the gas detection device to be introduced rapidly, flow stably, and transported above the particulate sensor 325. At this time, a projecting light beam emitted from the laser component 324 passes through the transparent window 3214*b* to irritate the suspended particles contained in the gas flowing above the particulate sensor 325 in the gas-inlet groove 3214. When the suspended particles contained in the gas are irradiated and generate scattered light spots, the scattered light spots are received and calculated by the particulate sensor 325 for obtaining related information about the sizes and the concentration of the suspended particles contained in the gas. Moreover, the gas above the particulate sensor 325 is continuously driven and transported by the piezoelectric actuator 322, flows into the ventilation hole 3215*a* of the gas-guiding-component loading region 3215, and is transported to the gas-outlet groove 3216. At last, after the gas flows into the gas outlet groove 3216, the gas is continuously transported into the gas-outlet groove 3216 by the piezoelectric actuator 322, and thus the gas in the gas-outlet groove 3216 is pushed to discharge through the gas-outlet 3216*a* and the outlet opening 3261*b*.

In the present disclosure, the outdoor gas detection device A1 or the gas detection device A disposed in the indoor space can not only detect the suspended particles in the gas, but also further detect the characteristics of the imported gas, such as formaldehyde, ammonia, carbon monoxide, carbon dioxide, oxygen and ozone. Therefore, the gas detection device A1 disposed in the outdoor space or the gas detection device A disposed in the indoor space of the present disclosure further includes a gas sensor 327*a*. Preferably but not exclusively, the gas sensor 327*a* is positioned and electrically connected to the driving circuit board 323, and is accommodated in the gas outlet groove 3216, so as to detect the concentration or the characteristics of volatile organic compounds contained in the gas drained out through the outlet path, and detect the concentration, the species or the size of bacteria, fungi, virus contained in the gas drained out through the outlet path.

In another preferred embodiment of the present disclosure, as shown in FIG. 1A and FIG. 1B, the plurality of gas detection devices A are disposed in the indoor space for detecting the air pollution. Moreover, each filtration device B further includes a gas detection device A disposed therein and a driver C for receiving the air pollution data detected by the gas detection device A. Preferably but not exclusively, the gas detection device A is integrated with the driver C.

Therefore, as shown in FIG. 1A and FIG. 1B, the present disclosure provides an air pollution detecting and purifying prevention method for locating air pollution in an indoor space and implementing detection, filtration and purification. The method includes the following steps.

Firstly, in the step 1, a plurality of gas detection devices A are provided and disposed in the indoor space for detecting the air pollution. In the embodiment, the plurality of gas detection devices detect and output air pollution data.

In the step 2, a connection device is provided for implementing an intelligent computation. In the embodiment, the connection device receives and compares the air pollution data detected by the gas detection devices A for intelligently computing and determining the location of the air pollution in the indoor space and intelligently and selectively issuing a controlling instruction.

In the step 3, a plurality of filtration devices B are provided and disposed in the indoor space. Moreover, each filtration device B includes a gas detection device A disposed therein and a driver C for receiving the air pollution data detected by the gas detection device A. When the driver C determines the air pollution data exceeding a safety detection value or the driver C receives the controlling instruction, the driver C controls the corresponding filtration device to be enabled In the embodiment, the indoor space has an area divided by 10 pings to obtain a cardinal number, the cardinal number is multiplied by 13 to obtain a maximum number for disposing the plurality of gas detection devices B in the indoor space, and a ratio of the maximum number of the gas detection devices B to the area of the indoor space is ranged from 1.3 to 13, so that it allows to enable the plurality of filtration devices B within less than 5 minutes, the air pollution in the indoor space is filtered and cleared to reach the safety detection value, and a clean and safely breathable air state is generated.

Preferably but not exclusively, in the embodiment, the connection device includes the mobile device D of FIG. 1A, and a networking relay station E2 and a cloud database E2 of FIG. 1B, for implementing the intelligent computation. In the embodiment, the connection device receives and compares the air pollution data detected by the plurality of gas detection devices A, the intelligent computation is performed to determine a location of the air pollution in the indoor space, and a controlling instruction is intelligently and selectively issued. In the embodiment, the controlling instruction is provided and received by the drivers C of the plurality of filtration devices B, thereby the driver C controls the corresponding filtration device B to be enabled. In an embodiment, as shown in FIG. 1A, the connection device is a mobile device D. The mobile device D is directly linked to the database or big data database of the cloud device through the application program (APP) to implement the intelligent computation. The air pollution data detected by the plurality of gas detection devices A are received and compared for intelligently computing and determining the location of the air pollution in the indoor space, and a controlling instruction is intelligently and selectively issued. The controlling instruction is provided and received by the drivers C of the plurality of filtration devices B. When the driver C determines the air pollution data exceeding a safety detection value or the driver C receives the controlling instruction, the driver C controls the corresponding filtration device B to be enabled. In another embodiment, as shown in FIG. 1B, the connection device is a cloud processing device. The cloud processing device includes a networking relay station E2 linked with a cloud database E2. The networking relay station E2 is directly linked to the cloud database E3 to implement the intelligent computation. The air pollution data detected by the plurality of gas detection devices A are received and compared for intelligently computing and determining the location of the air pollution in the indoor space, and a controlling instruction is intelligently and selectively issued. The controlling instruction is provided and received by the drivers C of the plurality of filtration devices B. Thereby, when the driver C determines the air pollution data exceeding a safety detection value or the driver C receives the controlling instruction, the driver C controls the corresponding filtration device B to be enabled.

In an embodiment, the connection device receives and compares the air pollution data detected by at least three of the gas detection devices A in the indoor space for intelligently computing and determining the location of the air pollution in the indoor space based on the highest one of the air pollution data. In that, the connection device intelligently and selectively issues the controlling instruction to enable the filtration device B closest to the location of the air pollution, and then intelligently and selectively issues the controlling instruction to further enable the rest of the filtration devices B to generate a directional airflow convection, so that a flow of the air pollution is accelerated by the directional airflow convection to move toward the filtration device B closest to the location of the air pollution for being filtered and cleaned.

From the above descriptions, it can be known that the method of the present disclosure is implemented in another embodiment to dispose an effective number of gas detection devices A at the lowest cost in the indoor space, rapidly detect and locate the air pollution, and effectively control the plurality of filtration devices B to generate an intelligent airflow convection and accelerate the airflow in a desired direction(s), so that the air pollution is filtered and cleaned to the safety detection value and a clean and safely breathable air state is obtained.

In summary, the present disclosure provides an indoor air pollution detecting and purifying prevention method. By disposing an effective number of gas detection devices A at the lowest cost in the indoor space, it allows to rapidly detect and locate the air pollution, and effectively control a plurality of filtration devices B to generate an intelligent airflow convection and accelerate the airflow in a desired direction (s), so that the air pollution is filtered and cleaned to reach a safety detection value and a clean and safely breathable air state is obtained.

What is claimed is:

1. An indoor air pollution detecting and purifying prevention method, for locating air pollution in an indoor space and implementing detection, filtration and purification, comprising:

providing a plurality of gas detection devices, disposed in the indoor space for detecting the air pollution, wherein the plurality of gas detection devices detect and output air pollution data, wherein no more than 13 of the gas detection devices are installed per 10 ping of the indoor space;

providing a plurality of filtration devices disposed in the indoor space, each of the plurality of filtration devices comprising a driver for receiving the air pollution data detected by the gas detection devices;

determining whether the air pollution data exceeding a safety detection value or not by the driver, wherein when the air pollution data exceeds the safety detection value,, the driver controls the corresponding filtration device to be enabled, wherein a connection device is further provided to receive and compare the air pollution data detected by the plurality of gas detection devices, a computation is performed to determine a location of the air pollution in the indoor space, and a controlling instruction is issued, wherein the controlling instruction is provided and received by the drivers of the plurality of filtration devices, thereby the driver controls the corresponding filtration device to be enabled, wherein the connection device issues the controlling instruction to enable the filtration device closest to the location of the air pollution, and then issues the controlling instruction to further enable the rest of the filtration devices to generate a directional airflow convection, so that a flow of the air pollution is accelerated by the directional airflow convection to move toward the filtration device closest to the location of the air pollution for being filtered and cleaned.

2. The indoor air pollution detecting and purifying prevention method according to claim 1, wherein the air pollution is at least one selected from the group consisting of particulate matter, carbon monoxide, carbon dioxide, ozone, sulfur dioxide, nitrogen dioxide, lead, total volatile organic compounds (TVOC), formaldehyde, bacteria, fungi, virus and a combination thereof.

3. The indoor air pollution detecting and purifying prevention method according to claim 1, wherein the connection device receives and compares the air pollution data detected by at least three of the gas detection devices in the indoor space for computing and determining the location of the air pollution in the indoor space based on the highest one of the air pollution data.

4. The indoor air pollution detecting and purifying prevention method according to claim 1, wherein the connection device is one selected from the group consisting of a mobile device, a cloud processing device and a combination thereof.

5. The indoor air pollution detecting and purifying prevention method according to claim 1, wherein the safety detection value includes at least one selected from the group consisting of a concentration of PM2.5 which is less than 10 μg/m3, a concentration of carbon dioxide which is less than 1000 ppm, a concentration of total volatile organic compounds which is less than 0.56 ppm, a concentration of formaldehyde which is less than 0.08 ppm, a colony-forming unit of bacteria which is less than 1500 CFU/m3, a colony-forming unit of fungi which is less than 1000CFU/m3, a concentration of sulfur dioxide which is less than 0.075 ppm, a concentration of nitrogen dioxide which is less than 0.1 ppm, a concentration of carbon monoxide which is less than 9 ppm, a concentration of ozone which is less than 0.06 ppm, a concentration of lead which is less than 0.15 μg/m3 and a combination thereof.

6. The indoor air pollution detecting and purifying prevention method according to claim 1, wherein the plurality of gas detection devices are fixedly disposed in the indoor space.

7. The indoor air pollution detecting and purifying prevention method according to claim 1, wherein the plurality of gas detection devices are movably disposed in the indoor space.

8. The indoor air pollution detecting and purifying prevention method according to claim 1, wherein the indoor space has the area of x pings, the maximum number of the gas detection devices disposed in the indoor space is y, and x and y are selected from (1)$x<10$ and $y=13$, (2) $10\leq x<20$ and $y=26$, (3) $20\leq x<30$ and $y=39$, (4) $30\leq x<40$ and $y=52$, (5) $40\leq x<50$ and $y=65$, (6) $50\leq x<60$ and $y=78$, (7) $60\leq x<70$ and $y=91$, (8) $70\leq x<80$ and $y=104$, (9) $80\leq x<90$ and $y=117$ or (10) $90\leq x<100$ and $y=130$.

9. The indoor air pollution detecting and purifying prevention method according to claim 1, wherein the gas detection device comprises a controlling circuit board, a gas detection main part, a microprocessor and a communicator, and the gas detection main part, the microprocessor and the communicator are integrally packaged on the controlling circuit board and electrically connected to the controlling circuit board, wherein the microprocessor controls the detection of the gas detection main part, the gas detection main part detects the air pollution and outputs a detection signal, and the microprocessor receives and processes the detection signal to generate the air pollution data and provides the air pollution data to the communicator for a wireless communication transmission externally.

10. The indoor air pollution detecting and purifying prevention method according to claim 9, wherein the wireless communication transmission is one selected from the group consisting of a Wi-Fi communication transmission, a Bluetooth communication transmission, a radio frequency identification communication transmission and a near field communication (NFC) transmission for external transmission.

11. The indoor air pollution detecting and purifying prevention method according to claim 9, wherein the gas detection main part comprises:

a base comprising:

a first surface;

a second surface opposite to the first surface;

a laser loading region hollowed out from the first surface to the second surface;

a gas-inlet groove concavely formed from the second surface and disposed adjacent to the laser loading region, wherein the gas-inlet groove comprises a gas-inlet and two lateral walls, the gas-inlet is in communication with an environment outside the base, and a transparent window is opened on the two lateral walls and is in communication with the laser loading region;

a gas-guiding-component loading region concavely formed from the second surface and in communication with the gas-inlet groove, wherein a ventilation hole penetrates a bottom surface of the gas-guiding-component loading region; and a gas-outlet groove concavely formed from the first surface, spatially corresponding to the bottom surface of the gas-guiding-component loading region, and hollowed out from the first surface to the second surface in a region where the first surface is not aligned with the gas-guiding-component loading region, wherein the gas-outlet groove is in communication with the ventilation hole, and a gas-outlet is disposed in the gas-outlet groove;

a piezoelectric actuator accommodated in the gas-guiding-component loading region;

a driving circuit board covering and attached to the second surface of the base;

a laser component positioned and disposed on the driving circuit board, electrically connected to the driving circuit board, and accommodated in the laser loading region, wherein a light beam path emitted from the laser component passes through the transparent window and extends in a direction perpendicular to the gas-inlet groove, thereby forming an orthogonal direction with the gas-inlet groove;

a particulate sensor positioned and disposed on the driving circuit board, electrically connected to the driving circuit board, and disposed at an orthogonal position where the gas-inlet groove intersects the light beam path of the laser component in the orthogonal direction, so that suspended particles contained in the air pollution passing through the gas-inlet groove and irradiated by a projecting light beam emitted from the laser component are detected;

a gas sensor positioned and disposed on the driving circuit board, electrically connected to the driving circuit board, and accommodated in the gas-outlet groove, so as to detect the air pollution introduced into the gas-outlet groove; and an outer cover covering the base and comprising a side plate, wherein the side plate has an inlet opening and an outlet opening, the inlet opening is spatially corresponding to the gas-inlet of the base, and the outlet opening is spatially corresponding to the gas-outlet of the base;

wherein the outer cover covers the base, and the driving circuit board covers the second surface, thereby an inlet path is defined by the gas-inlet groove, and an outlet path is defined by the gas-outlet groove, so that the air pollution is inhaled from the environment outside the base by the piezoelectric actuator, transported into the inlet path defined by the gas-inlet groove through the inlet opening, and passes through the particulate sensor to detect the particle concentration of the suspended particles contained in the air pollution, and the air pollution transported through the piezoelectric actuator is transported out of the outlet path defined by the gas-outlet groove through the ventilation hole, passes through the gas sensor for detecting, and then discharged through the outlet opening.

12. The indoor air pollution detecting and purifying prevention method according to claim 11, wherein the particulate sensor detects information of suspended particulates.

13. The indoor air pollution detecting and purifying prevention method according to claim 11, wherein the gas sensor comprises one selected from the group consisting of a volatile-organic-compound sensor, a formaldehyde sensor, a bacteria sensor, a virus sensor and a combination thereof, wherein the volatile-organic-compound sensor detects information of carbon dioxide or total volatile organic compounds, the formaldehyde sensor detects information of formaldehyde, the bacteria sensor detects information of bacteria or fungi, and the virus sensor detecting information of virus.

14. The indoor air pollution detecting and purifying prevention method according to claim 1, wherein the filtration device further comprises a gas guider and a filtering and purifying module, wherein the air pollution is transported by the gas guider to pass through the filtering and purifying module for filtering and purifying.

15. An indoor air pollution detecting and purifying prevention method, for locating air pollution in an indoor space and implementing detection, filtration and purification, comprising:

providing a plurality of gas detection devices, disposed in the indoor space for detecting the air pollution, wherein the plurality of gas detection devices detect and output air pollution data, wherein no more than 13 of the gas detection devices are installed per 10 ping of the indoor space, and a ratio of the maximum number of the gas detection devices to the area of the indoor space is ranged from 1.3 to 13;

providing a connection device, wherein the connection device receives and compares the air pollution data detected by the gas detection devices for computing and determining the location of the air pollution in the indoor space and issuing a controlling instruction; and providing a plurality of filtration devices disposed in the indoor space, each of the plurality of filtration devices comprising a gas detection device disposed therein and a driver for receiving air pollution data detected by the gas detection device;

determining whether the air pollution data exceeding a safety detection value or not by the driver, wherein when the air pollution data exceeds the safety detection value, or the driver receives the controlling instruction, the driver controls the corresponding filtration device to be enabled, wherein the connection device issues the controlling instruction to enable the filtration device closest to the location of the air pollution, and then issues the controlling instruction to further enable the rest of the filtration devices to generate a directional airflow convection, so that a flow of the air pollution is accelerated by the directional airflow convection to move toward the filtration device closest to the location of the air pollution for being filtered and cleaned.

* * * * *